United States Patent [19]

Papst et al.

[11] 4,373,861

[45] Feb. 15, 1983

[54] AXIAL-FLOW FAN

[75] Inventors: Georg F. Papst; Siegfried Harmsen, both of St. Georgen; Günter Wrobel, Villingen, all of Fed. Rep. of Germany

[73] Assignee: Papst-Motoren KG, Georgen, Fed. Rep. of Germany

[21] Appl. No.: 140,883

[22] Filed: Apr. 16, 1980

[30] Foreign Application Priority Data

Oct. 6, 1979 [DE] Fed. Rep. of Germany ..... 2940650

[51] Int. Cl.[3] ..... F04D 25/08; F04D 29/44

[52] U.S. Cl. ..... 415/213 C; 417/354

[58] Field of Search ..... 417/354, 353, 352; 415/213 C; 416/243, 242

[56] References Cited

U.S. PATENT DOCUMENTS

| | | | |
|---|---|---|---|
| 2,468,723 | 4/1949 | Bartlett, Jr. | 416/243 |
| 3,128,939 | 4/1964 | Szydlowski | 416/242 |
| 3,144,201 | 8/1964 | Rundle | 416/242 |
| 3,294,315 | 12/1966 | Stewart | 415/213 C |
| 3,362,627 | 1/1968 | Papst | 417/354 |
| 3,378,192 | 4/1968 | Friese | 417/353 |
| 3,531,221 | 9/1970 | Herberg et al. | 417/354 |
| 4,167,376 | 9/1979 | Papst | 417/354 |
| 4,221,546 | 9/1980 | Papst et al. | 417/354 |

FOREIGN PATENT DOCUMENTS

| | | | |
|---|---|---|---|
| 448909 | 6/1948 | Canada | 416/243 |
| 1503600 | 7/1970 | Fed. Rep. of Germany | 416/243 |
| 1133676 | 4/1957 | France | 416/242 |

*Primary Examiner*—Leonard E. Smith
*Attorney, Agent, or Firm*—Paul M. Craig, Jr.

[57] ABSTRACT

An axial-flow fan is disclosed which comprises a fan wheel and a housing casing surrounding said fan wheel, the fan wheel having a hub with a diameter which is at least half as large as the inner diameter of the housing casing and wherein the housing casing is cylindrical in the axial central plane and is broadened at least toward the exhaust side by way of corner pockets into a square profile circumscribing the diameter of the fan wheel. The hub of the fan wheel is provided on the inlet side with an annular surface which extends approximately over one-third of the entire axial length of said hub and which has a conical configuration toward the end face.

12 Claims, 6 Drawing Figures

AXIAL-FLOW FAN

BACKGROUND AND SUMMARY OF THE INVENTION

The present invention relates to an axial-flow fan, especially a small-scale fan with a hub diameter of the fan wheel which is at least half as large as the inner diameter of the casing surrounding the fan wheel, which has a cylindrical configuration in the axial center plane and is broadened at least toward the exhaust side by way of corner pockets into a square profile circumscribing the diameter of the fan wheel.

Axial-flow fans of this type are conventional U.S. Pat. No. 3,362,627. In the conventional types of construction, the hub of the fan wheel is fashioned as the motor casing to be essentially cylindrical, wherein the rotor of an external-rotor motor is disposed within this casing, the stator of this motor being mounted to a flange fixedly joined to the casing by way of spokes. Axial-flow fans of this type are primarily installed in electronic appliances to serve as ventilators, where the external dimensions of the casing jacket are predetermined. On account of the small dimensions—the casing has predominantly square outside faces with a length of about 80 mm.—it is either impossible or possible only at very high expense, for reasons of electric motor technology and manufacturing techniques, to make the diameter of the motor housing smaller than corresponds to about two-thirds and, at the minimum, about one-half the internal diameter of the casing enclosing the fan wheel. This results in relatively small radial lengths for the blades, so that axial-flow fans of this type can hardly be improved upon any more in their efficiency with economical expenditure. Increasing the casing diameter is eliminated for the reasons mentioned above. A speed increase leads to a rise in the noise level which in such axial-flow fans must likewise be kept at a minimum, and is furthermore possible only to a minor extent due to the given mains frequency.

Additionally, in the electronic appliances which are becoming increasingly more compact, the intake and exhaust chambers upstream and downstream of the axial-flow fans are exceedingly small so that axial-flow fans of the type mentioned in the foregoing must frequently operate at very high counterpressures. The ensuing, reduced air flow rate had to be tolerated heretofore.

An object of the present invention is to provide an axial-flow fan of the aforementioned type which avoids these disadvantages associated with the known fans and which, specifically, makes it possible to provide an increase in efficiency at least in a partial area of the characteristic output curve, without having to abandon the total concept or having to take complicated measures.

The invention resides in providing the hub of the fan wheel on the inlet side with an annular surface extending approximately over one-third of the entire axial length and being of a conical configuration toward the end face. This feature, which is known per se in axial-flow fans of a different type of construction and is utilized particularly in relatively large axial-flow fans, surprisingly produces the advantage, in conjunction with the special features of the casing design, that the novel axial-flow fan of the present invention provides a markedly larger pressure increase in the region of relatively low air flow rates, so that the fan in this operating range can convey, at higher counterpressures, a larger amount of air. Therefore, especially when installed in appliances of the kind mentioned in the foregoing and when operating, due to the compact structure thereof, against higher counterpressures, the novel axial-flow fan of the present invention is superior to the units known heretofore. In the remaining pressure and air flow range, the novel fan is at least equivalent, and has the further advantage that it produces the increased amount of air in the region of higher static pressures at a markedly lower noise level, which has been proven unequivocally by measuring the noise level with axial-flow fans of a conventional type of structure and with the novel arrangement when installed in a test chamber, i.e. when operating against increased counterpressure.

It is advantageous to make the angle of the annular surface with respect to the axial direction to be about 20°, because in this case an inwardly oriented flaring portion of the inlet region is obtained on an order of magnitude maximal for the fan efficiency. It is also particularly advantageous to arrange only seven or five fan blades uniformly over the periphery of the hub fashioned as the motor housing, which blades are suitably made of thin steel and are conventionally welded onto the motor housing. If these fan blades are provided over the entire axial length of the motor housing in such a way that they also contact with their inner edges the zones of the conical annular surface at the motor casing, then especially favorable efficiency values are obtained, which may be due to the fact that the inlet cross section can be optimally enlarged because of the very thin end faces of the fan blades and the conical configuration of the motor casing.

These and other objects, features and advantages of the present invention will become more apparent from the following description when taken in connection with the accompanying drawings, which show, for purposes of illustration only, one embodiment in accordance with the present invention.

DETAILED DESCRIPTION OF THE DRAWINGS

Figure 1:
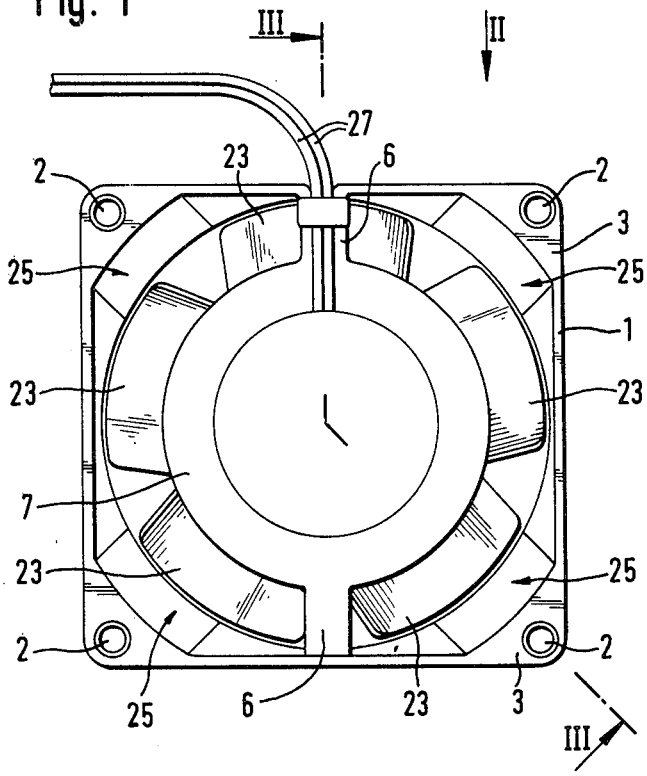
FIG. 1 is a schematic view of one embodiment of the novel axial-flow fan according to the present invention as seen from the exhaust side
Figure 2:
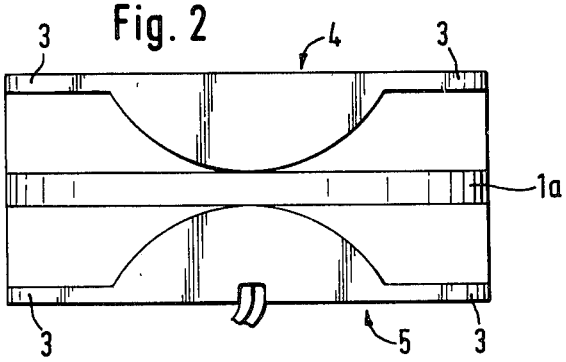
FIG. 2 is a top view of the fan of FIG. 1 as seen in the direction of arrow II in the figure.
Figure 3:
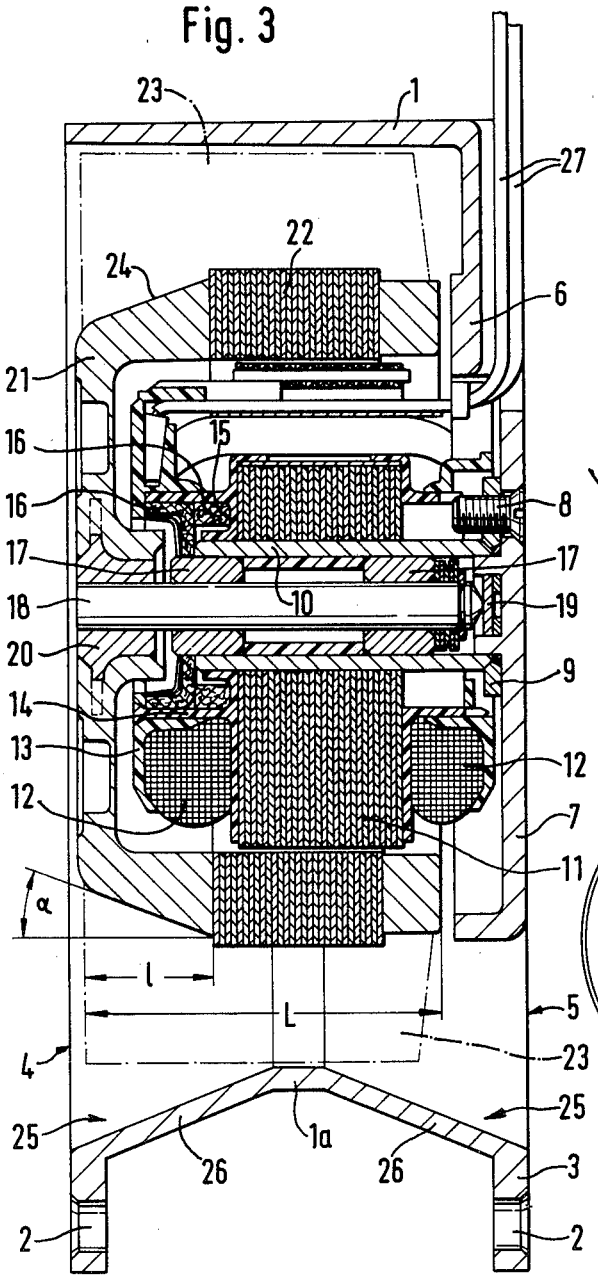
FIG. 3 is a section in an enlarged representation taken along the line III—III of FIG. 1.

FIGS. 1–3 show a casing 1 manufactured from die-cast aluminum for an axial-flow fan, having square outer dimensions and provided on the four corners resepctively with mounting bores 2. The mounting bores 2 are arranged in corner flanges 3 extending beyond the casing, which latter is otherwise adapted to the cylindrical configuration. As can be seen from FIG. 3, such corner flanges 3 are arranged respectively on the inlet side 4 of the casing and on the outlet side 5. The casing 1 is equipped on the exhaust side 5 with two diametrically opposed struts 6 carrying a flange 7, the latter having been manufactured integrally with the casing 1. A pipe 10 is attached to the flange 7 by way of the screws 8 and via the auxiliary flange 9; the stator 11 with the coil winding heads 12 is attached to this pipe on the outside. The coil winding heads 12 are sealed toward the front by way of a cover cap 13 made of an insulating material, this cap engaging a ring 14, which latter is provided with a recess 15 toward the pipe. A ring 16 having the structure of a wick and containing a lubricant is inserted in this recess. This ring 16 adjoins toward the outside a second, angular lubricant ring 16', the inner diameter of which supplies the sliding bearing 17 with lubricant. With the aid of this bearing, the shaft 18 for the rotor of the electric motor is supported in casing 1. The shaft 18 is supported, in the zone of its end facing away from the inlet side 4, in a further sliding bearing 17 and abuts with its end face an axial bearing 19 arranged in the flange 7. The motor housing 21 is fixedly joined to the shaft 18 via the bushing 20; on the outside, the motor housing is fashioned in one piece as a squirrel-cage motor, the bars of which extend conventionally through the laminated sheets 22 of the rotor. Five fan blades 23 uniformly distributed along the periphery and made of steel sheet are fixedly connected with the motor housing 21; these fan blades extend over the entire axial length of the motor housing 21. The latter is provided, in the zone toward the inlet side 4, with a conical annular surface 24 forming an angle $\alpha$ of 20° with respect to the axis of the shaft 18. This annular surface 24 exhibits an axial length $l$ corresponding to about one-third of the total axial length L of the motor housing.

By means of this arrangement, as can be seen particularly from FIG. 3, a broader inlet cross section is obtained over the entire inlet zone of the axial-flow fan; the front edges of the fan blades 23 extend into this cross section, since they are brought up approximately to the forward end face of the casing 1 with their front edges and contact, with their inner edges, the motor housing 21 also in the zone of the conical surface 24. The fan blades 23 are welded conventionally to the motor housing 21 by a special process (German Pat. No. 1,628,349). Since they consists of very thin steel sheet, and only five fan blades are arranged distributed over the periphery, a very large free inlet region is obtained which is enlarged even more by the provision of the conical surface 24.

Since the casing 1, as can be seen from FIGS. 1 and 3, is provided, on the four diagonally opposite corners of the externally square casing 1, with corner pockets 25, the inclined wall sections 26 of which emanate from a central cylindrical middle piece 1*a*, the inlet cross section is additionally enlarged at these four corners. It has been found that an axial-flow fan constructed in this way has advantages over conventional kinds of construction especially if it must operate against higher pressures in the installed condition. In such a case, the fan yields surprisingly larger amounts of air.

Figure 4:
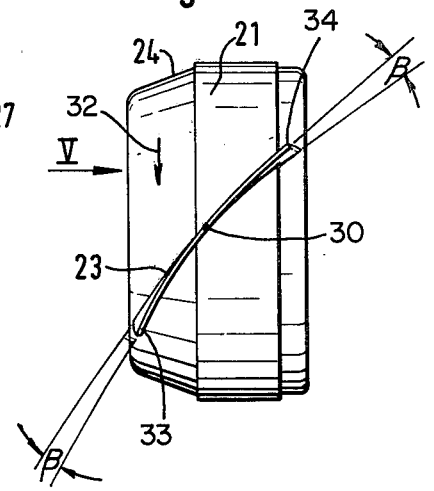
FIG. 4 is a top view of the motor casing constituting the fan rotor with a fan blade welded thereto.

As illustrated in FIG. 4, the fan blades 23 in their axial central part 30 have an essentially radially straight contour, perpendicular to the axis of rotation, with the upstream part 33 of the blade being inclined in its radial form in the direction of rotation 32 by angle $\beta$, whereas the downstream part 34 of the blade is inclined in its radial form opposite to the direction of rotation by the angle $\beta'$.

Figure 5:
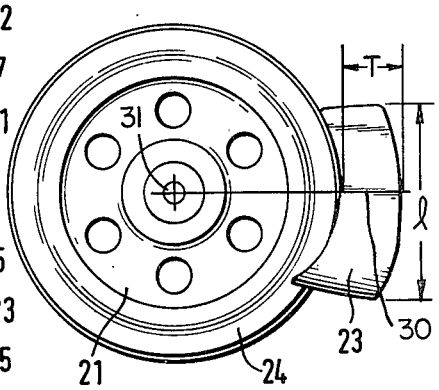
FIG. 5 is an elevational view of the motor casing in the direction of arrow V in FIG. 4.

Further, as viewed in axial direction as shown in FIG. 5, the fan blades 23 have a ratio of their average radial dimension r to their length $l$ of about 1 to 4.

The axial-flow fan is supplied with current in a manner known per se by way of the two leads 27.

Figure 6:
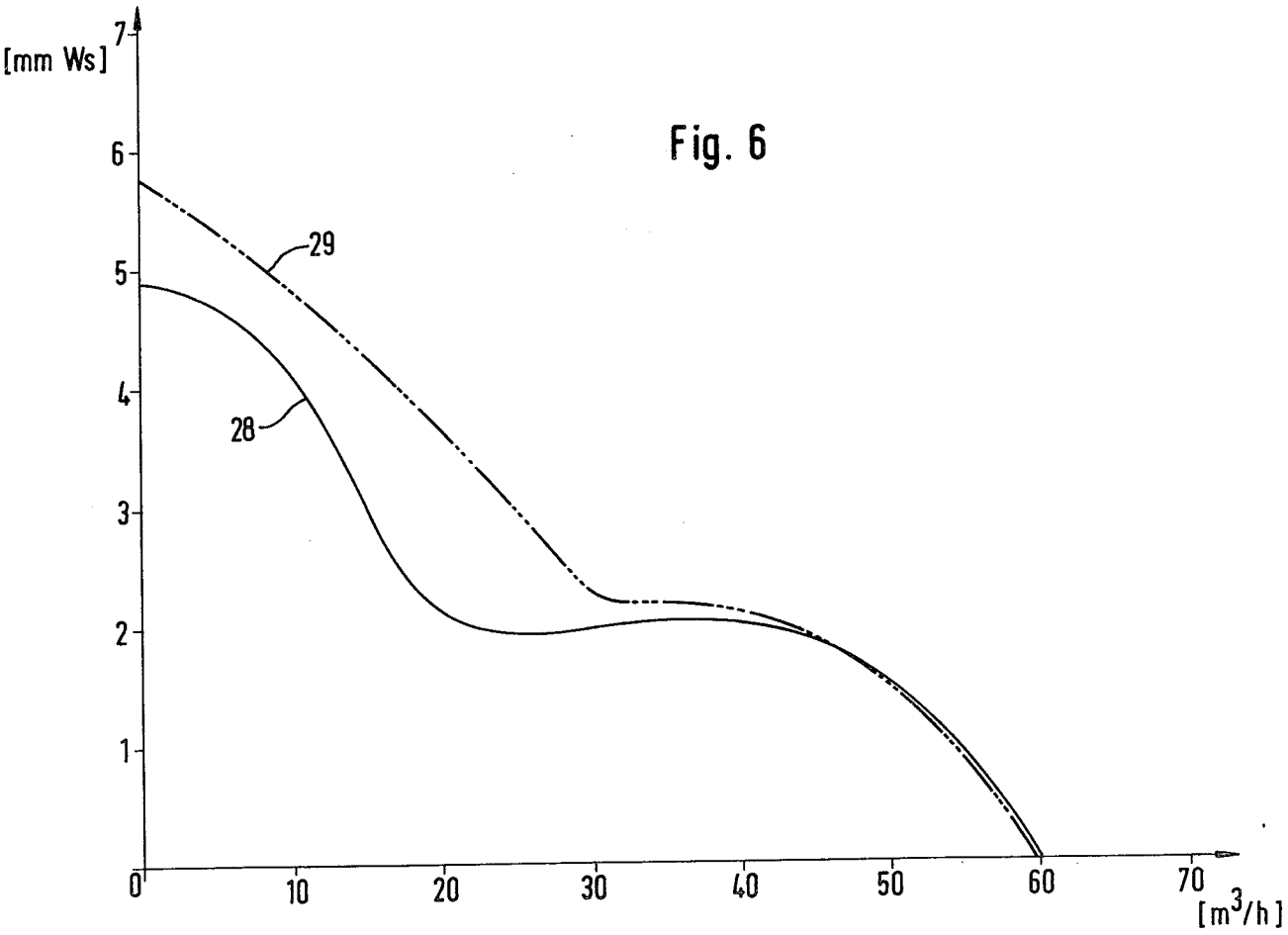
FIG. 6 is a schematic illustration of the curve of the air flow rate plotted over the static pressure, measured on an axial-flow fan according to the present invention and on an axial-flow fan according to the prior art.

FIG. 6 illustrates the characteristic curve of the novel axial-flow fan as compared with the characteristic curve of an axial-flow fan of the prior art (German Pat. No. 1,728,338). It can clearly be seen that, at higher static pressures downstream of the fan and accordingly at a lower air flow rate, the novel axial-flow fan is clearly superior to the conventional types of construction. The characteristic curve 28 corresponds to the prior-art type of construction, whereas the characteristic curve 29 pertains to the novel axial-flow fan. The novel axial-flow fan therefore has advantages when installed for the ventilation of devices where there is only a limited amount of space available for installation.

It is also possible to arrange seven fan blades uniformly over the periphery of the motor housing 21 forming the hub of the fan wheel. It has been found that also in this case advantages are attained in pressure increase in the zone of relatively small throughput volumes, and the noise level can be kept low.

While we have shown and described only one embodiment in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

We claim:

1. An axial-flow fan comprising a fan wheel and a housing casing surrounding said fan wheel over at least substantially the entire axial length of said fan wheel, the fan wheel having a hub with a diameter which is at least half as large as the inner diameter of the housing casing wherein said housing casing is cylindrical in the axial central part and is broadened at least toward the exhaust side by way of corner pockets formed by essentially smooth walls into a square profile circumscribing the diameter of the fan wheel, said hub of the fan wheel being provided on the inlet side with an annular surface which extends approximately over one-third of the entire axial length of said hub and which has a conical configuration toward the end face.

2. An axial-flow fan according to claim 1, wherein said fan is a small-scale fan with the outside faces of said square profile each having a length on the order of 80 mm.

3. An axial-flow fan according to claim 1 or 2, wherein seven fan blades are arranged in uniform distribution over the periphery of the hub.

4. An axial-flow fan according to claim 1 or 2, wherein said corner pockets are formed by essentially smooth inclined walls which extend from said central cylindrical port.

5. An axial-flow fan according to claim 1 or 2, wherein the angle of the annular surface with respect to the axial direction is about 20°.

6. An axial-flow fan according to claim 5, wherein five fan blades are arranged in uniform distribution over the periphery of the hub.

7. An axial-flow fan according to claim 5, wherein the hub is part of a motor housing of an external-rotor motor of the fan.

8. An axial-flow fan according to claim 1, wherein five fan blades are arranged in uniform distribution over the periphery of the hub.

9. An axial-flow fan according to claim 8 wherein said fan wheel comprises fan blades formed of thin steel sheet which are welded to the motor housing.

10. An axial-flow fan according to claim 8, wherein said fan wheel comprises fan blades which extend over the entire axial length of the motor housing and contact with their inner edges the motor housing in the zone of the conical annular surface.

11. An axial-flow fan according to claim 1, said fan blades in their axial central part having an essential radial straight contour, perpendicular to the axis of rotation and the upstream part of said blade being inclined in its radial form in the direction of rotation, whereas the downstream part of said blade being inclined in its radial form opposite to the direction of rotation.

12. An axial-flow fan according to claim 11, said fan blades having a ratio of their average radial dimension to their length as viewed in the axial direction of about 1 to 4.

* * * * *